US005415092A

United States Patent [19]

Hern

[11] Patent Number: 5,415,092

[45] Date of Patent: May 16, 1995

[54] DEVICE FOR PRESETTING A CUT-OFF REGISTER IN A FOLDER OF A WEB-FED PRINTING PRESS

[75] Inventor: Joel C. Hern, Rollinsford, N.H.

[73] Assignee: Heidelberg Harris GmbH, Heidelberg, Germany

[21] Appl. No.: 189,749

[22] Filed: Feb. 1, 1994

Related U.S. Application Data

[62] Division of Ser. No. 947,765, Sep. 18, 1992, Pat. No. 5,299,770.

[51] Int. Cl.[6] ..... B41F 13/26

[52] U.S. Cl. ..... 101/226; 101/248; 250/571; 270/21.1; 226/45; 226/30

[58] Field of Search ..... 101/226, 248, 219, 181; 226/27–31, 45; 250/571; 270/21.1

[56] References Cited

U.S. PATENT DOCUMENTS

| | | | |
|---|---|---|---|
| 2,549,605 | 4/1951 | Huck | 101/181 |
| 3,808,971 | 5/1974 | Staamann | 101/181 |
| 3,955,502 | 5/1976 | Von Hofe | 101/226 |
| 4,361,260 | 11/1982 | Hanlan | 101/226 |
| 4,366,753 | 1/1983 | Glanz et al. | 101/181 |
| 4,512,256 | 4/1985 | Schriber et al. | 101/248 |
| 5,088,403 | 2/1992 | Shuji et al. | 101/227 |
| 5,119,725 | 6/1992 | Guamura et al. | 101/226 |

FOREIGN PATENT DOCUMENTS 3602894 5/1989 Germany .

*Primary Examiner*—Eugene H. Eickholt

*Attorney, Agent, or Firm*—Herbert L. Lerner; Laurence A. Greenberg

[57] ABSTRACT

A device for presetting a cut-off register in a folder of a web-fed printing press, includes a marking device for applying at least one mark in an image-free region between two printed images of a web, a detector for detecting the image-free region on the web, the detector being connected to the marking device for signalling the marking device when the image-free region is detected thereby, the marking device being disposed a defined distance in front of a nip located between cylinders of at least one printing unit, and a device for activating the marking device to apply a mark to the image-free region of the web when a respective output signal of the detector indicates the presence of the image-free region on the web.

4 Claims, 6 Drawing Sheets

DEVICE FOR PRESETTING A CUT-OFF REGISTER IN A FOLDER OF A WEB-FED PRINTING PRESS

This is a division of application Ser. No. 07/947,765, filed Sep. 18, 1992, now U.S. Pat. No 5299770.

The invention relates to a device for presetting a cut-off register in a folder of a web-fed printing press and, more particularly, to such a device having a marking device for applying at least one mark in an image-free region between two printed images of a web.

After a respective subject has been printed on the web, the web is folded in the folder into the respective formats and cut. In this regard, it is important that the cut-off register be maintained, especially if several webs in the folder are to be combined and collectively processed.

From German Patent 36 02 894, a cut-off register compensating device has become known heretofore. Several printing carrier webs are printed in individual printing presses and, thereafter, are guided to a folder via web guide rollers and a cutting cylinder. A revolving mark is arranged on one printing unit cylinder of each printing press, and is scanned by a respective scanning device. Additionally, a further mark is arranged on the cutting cylinder, which is also scanned by a scanning device. If, in a printing carrier web, an angle deviation occurs between the marks of the printing unit cylinders and the cutting cylinder, a correction of the respective printing carrier web takes place by means of the assigned paper guide rollers.

It is an object of the invention to provide a device of the foregoing general type, which serves for presetting the cut-off register in a folder of a web-fed printing press, in a much improved manner than may have been suggested by the prior art.

With the foregoing and other objects in view, there is provided, in accordance with the invention, a device for presetting a cut-off register in a folder of a web-fed printing press, comprising a marking device for applying at least one mark in an image-free region between two printed images of a web, detector means for detecting the image-free region on a web, the detector means being connected to the marking device for signalling the marking device when the image-free region is detected thereby, the marking device being disposed a defined distance in front of a nip located between cylinders of at least one printing unit, and means for activating the marking device to apply a mark to the image-free region of the web when a respective output signal of the detector indicates the presence of the image-free region on the web.

The device according to the invention makes it possible to correctly adjust the cut-off register before setting the printing pressure between the printing cylinders. Because of the marks which have been applied to the image-free region, the cutting device can be adjusted by manual or automatic correction, so that, from the very beginning, a correct cutting of the web or webs occurs in the image-free region.

In accordance with another feature of the invention, at least one of the cylinders is a blanket cylinder having a gap formed therein, and wherein the detector means have a reflecting detector for scanning the surface of the blanket cylinder, the defined distance at which the marking device is disposed in front of the nip corresponding to a circumferential distance extending from a measuring location of the reflection detector to the nip, the marking device being actuated when the gap formed in the blanket cylinder is detected by the reflection detector. The output signals of the reflection detector vary when the gap of the blanket cylinder passes below it. The gap of the blanket cylinder, therefore, defines the image-free region between the printed images which follow one another.

The output signals of the detector are transmitted to control means for the marking devices which, when recognizing the gap of the blanket cylinder, instantaneously activate the marking device. This marking device in front of the nip, preferably in front of the first printing unit, is arranged so that the distance thereof from the printing nip corresponds to the circumferential distance from the measuring location of the detector on the blanket cylinder to the printing nip. If the reflection detector, therefore, signals the output signal "gap" and "image-free region", respectively, the marking device is activated instantaneously, without the occurrence of any time delay.

The aforedescribed embodiment is capable of being used as long as the blanket cylinder is formed with a gap. If that is not the case, a modified embodiment of the device according to the invention provides for the reflection detector to be assigned to a plate cylinder of the printing press. The marking device is disposed a distance from the printing nip of a printing unit, which corresponds to a sum of circumferential distances on the plate cylinder and a blanket cylinder, from the measuring location of the detector to the printing nip. In this case, as well, a control device activates the marking device, as soon as it receives the signal "gap" and, "image-free region", respectively, from the, reflection detector.

Thus, in accordance with a further feature of the invention, the detector means have a reflection detector for scanning the surface of a plate cylinder having a gap formed therein and located adjacent one of the first-mentioned cylinders, the defined distance at which the marking device is disposed in front of the nip corresponding to a sum of circumferential distances extending from a necessary location of the detector means on the plate cylinder to the nip, the marking device being activated when the gap of the plate cylinder is detected by the reflection detector.

In accordance with another feature of the invention, the one first-mentioned cylinders is a blanket cylinder defining another nip with the plate cylinder, one of the circumferential distances extending from the measuring location of the detector means on the plate cylinder to the other nip, and the other of the circumferential distances extending from the other nip on the blanket cylinder to the first mentioned nip.

In accordance with an added feature of the invention, at least one of the cylinders is formed with a gap, and the detector means are assigned to another cylinder of the printing press carrying a reference mark thereon which revolves in synchronism with the gap of the one cylinder, the defined distance at which the marking device is disposed in front of the nip corresponding to a circumferential distance extending from a measuring location of the detector means to a given location provided on the outer cylindrical surface of the other cylinder and extending parallel to the nip. In this case, also, the marking device is again arranged a distance in front of the nip, so that a corresponding output signal of the detector activates the marking device via the control means, so that it places a mark on the image-free region of the web.

In accordance with an additional feature of the invention, the given location is at a nip defined by the other cylinder and a further cylinder of the printing press.

In accordance with yet another feature of the invention, the detector means comprise an angle detector mounted on a shaft of another cylinder of the printing press.

In accordance with yet a further feature of the invention, there are provided memory means for storing the angular position of the image-free regions of the web, the marking device being activated when it is in the image-free region of the web. When the stored angle-position is reached, the control means activate the marking device.

In accordance with yet an added feature of the invention, the distance of the marking device from the nip is increased by an integral multiple of the circumference of one of the cylinders.

In accordance with yet an additional feature of the invention, the marking device is formed of two parts and is arranged so that the marks are applied in at least one side region of the web. Thus, the marks may be applied on both sides of the web.

In accordance with still another feature of the invention, there are provided means for rendering the marking device inoperative, after printing pressure has been set. The means for rendering the marking device inoperative are part of the control means.

The construction of the marking device itself, especially auxiliary means by the aid of which the marks can be applied to the web, are manifold. Thus, in accordance still a further feature of the invention, the marking device is a device for printing the marks on the web.

In accordance with still an added feature of the invention, the marking device is an ink jet printing system for spraying the marks onto the web.

In accordance with still an additional feature of the invention, the marking device is formed of mechanical wheels for embossing the marks in the web.

In accordance with a concomitant feature of the invention, there are provided control means for recognizing the gap formed in the blanket cylinder and instantaneously activating the marking device. Other features which are considered as characteristic for the invention are set forth in the appended claims.

Although the invention is illustrated and described herein as embodied in a device for presetting a cut-off register in a folder of a web-fed printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
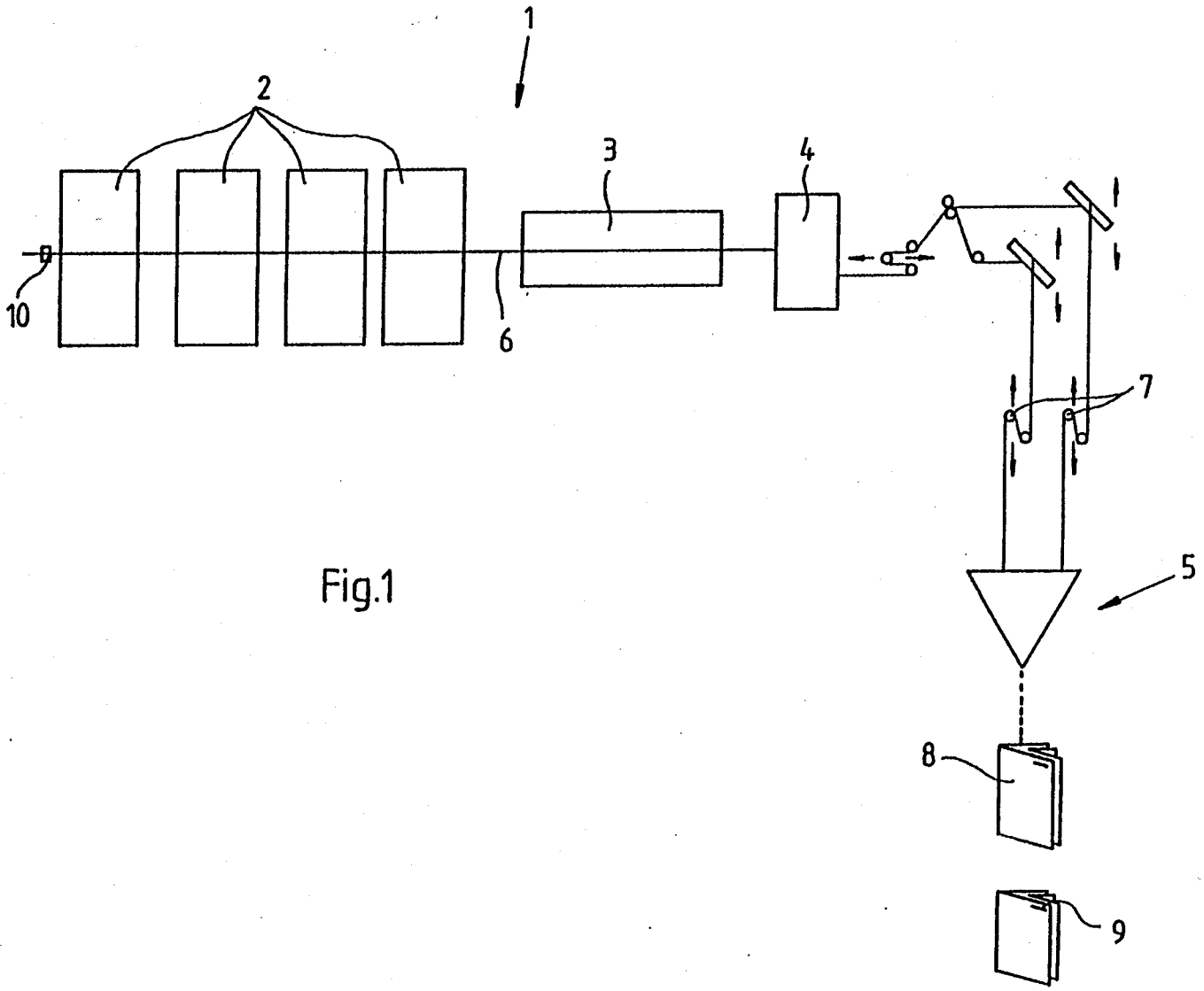
FIG. 1 is a schematic view of a web-fed printing press having a folder post-connected thereto.

Referring now to the drawings and, first, particularly to FIG. 1 thereof, there is shown therein a schematic side elevational view of a web-fed printing press 1 with a folder 5 post-connected thereto but otherwise not illustrated in detail. The web-fed printing press 1 per se is composed of printing units 2, a dryer 3 and a chill-roller system 4.

Customarily, several webs 6 are combined over a system of paper guide rollers 7 in the folder 5 and are concurrently folded and cut.

In accordance with the invention, a marking device 10 is arranged in front of the first printing unit and applies marks 9 onto side regions of the web 6 before any printing impression is made on the web 6. These marks 9 permit the webs 6 to be fed into the folder 5 in precise web-to-web register before the actual printing process takes place. The marking device 10 may be a direct printing device, an ink-Jet spray-printing device or may be formed with mechanical wheels for embossing the marks in the web.

Figure 2:
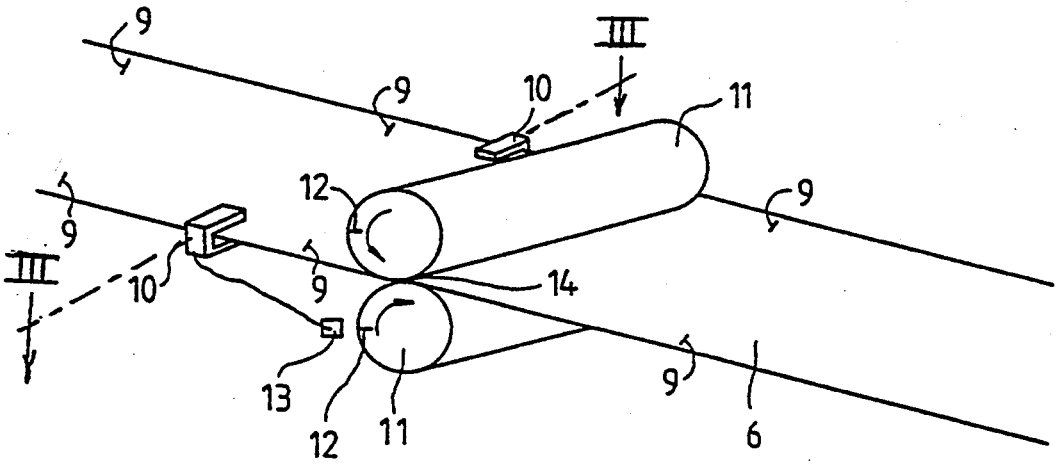
FIG. 2 is a diagrammatic perspective view of the device according to the invention.

FIG. 2 is a diagrammatic illustration of the device according to the invention. The web 6 runs between blanket cylinders 11 of a first printing unit 2, not otherwise illustrated in detail, of the web-fed printing press 1. When impression throw-on occurs, the line of contact of the blanket cylinders 11 defines a printing nip 14.

A reflection detector 13 is arranged in radial direction to one of the blanket cylinders 11. This detector 13 is formed of a radiation source and a receiver. The radiation source transmits radiation onto the surface of the cylinder 11. Due to that part of the radiation which is reflected from the surface, the evaluating device 15 recognizes when the gap or channel 12 formed in the blanket cylinder 11 passes underneath the detector 13. A suitable output signal of the detector 13 activates the marking device 10, which applies appropriate marks 9 to the web 6.

Figure 3:
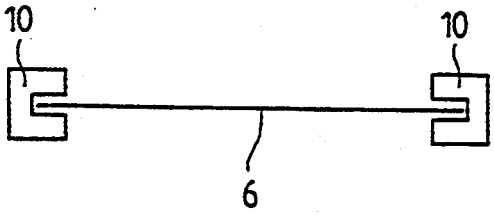
FIG. 3 is a slightly enlarged cross-sectional view of FIG. 2 taken along the line III—III in the direction of the arrows.

The same factual situation shown in FIG. 2 is illustrated in FIG. 3 in a cross-sectional view. The marking device 10 is arranged at both of the side regions of the web 6 and places the marks 9, respectively, on both sides of the web 6.

Figure 4:
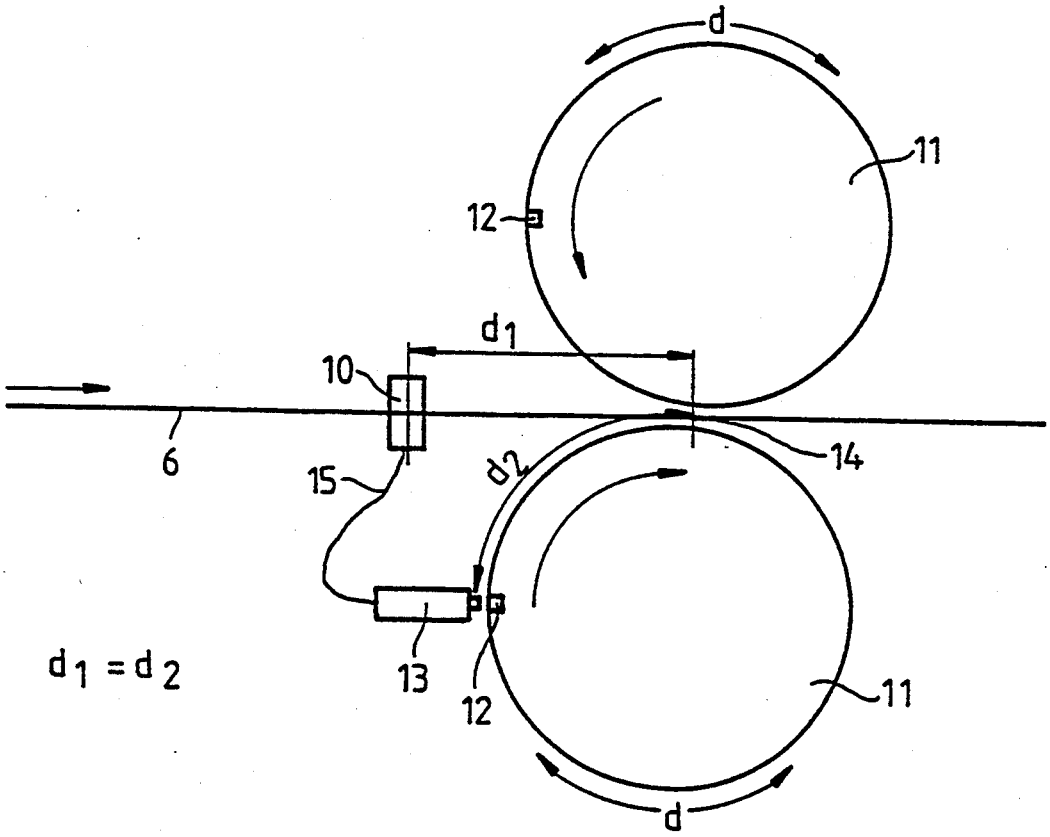
FIG. 4 is a much-enlarged side elevational view of FIG. 3 showing a first embodiment of the device according to the invention, in greater detail.

FIG. 4 shows a first embodiment of the device according to the invention in greater detail. The web 6 runs between two blanket cylinders 11 of a first printing unit 2, not otherwise shown in great detail. During the impression throw-on for which purpose the device according to the invention is provided, the blanket cylinders 11 are moved apart from one another.

A detector 13 is assigned to one of the blanket cylinders 11. This detector 13 is a reflection detector which recognizes the position of the gap 12 of the blanket cylinder 11 due to a reflected part of the radiation. The instant the detector 13 registers this signal "gap", it transmits a signal over a connecting line 15 to the marking device 10. This signal instantaneously activates the marking device 10. Assurance is thereby provided that the mark will be and is applied to the web 6 in the image-free region thereof and that the distance $d_1$ of the marking device 10 from the printing nip 14 corresponds to the circumferential distance $d_2$ from the measuring point of the detector 13 on the blanket cylinder 11 to the printing nip 14. The printing nip 14, during the printing process, i.e. during the setting of printing pressure, is defined as the contact line of both blanket cylinders 11. Because a respective output signal of the detector 13 instantaneously activates the marking device 10, no time delays occur.

In accordance with a further feature of the device according to the invention, the marking device 10 is disposed a distance $d_1$ from the printing nip 14, which is the sum of the circumferential distance $d_2$ from the measuring point of the detector 13 on the blanket cylinder 11 to the printing nip 14 and an integral multiple of the circumference d of the blanket cylinder 11.

Figure 5:
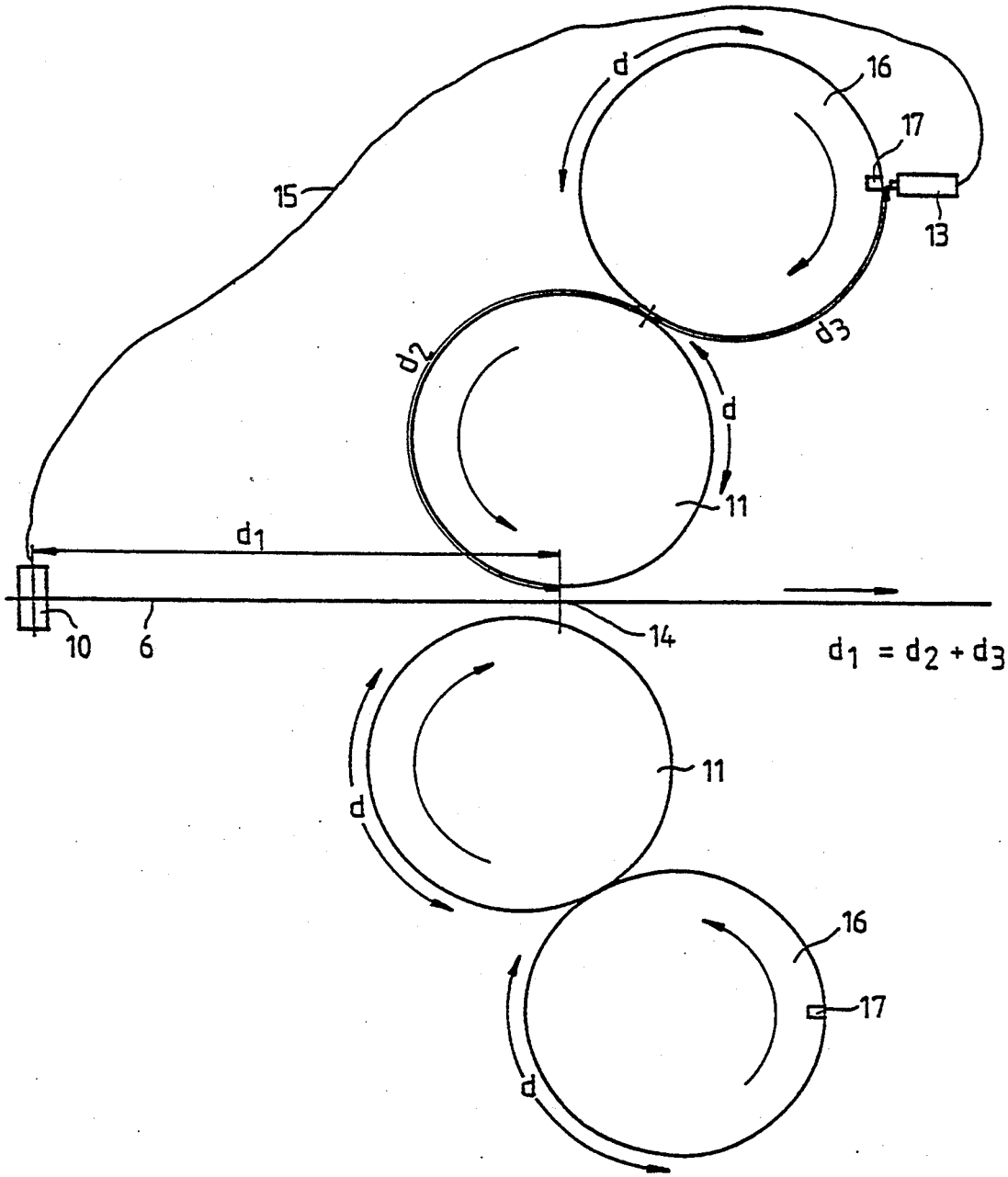
FIG. 5 is a view like that of FIG. 4 of a second embodiment of the device according to the invention.

An additional specific embodiment of the device according to the invention is illustrated in FIG. 5. This specific embodiment is employed when the blanket cylinder 11 is not formed with a gap or channel 12, which accordingly means that there cannot be any detection or recognition by the detector 13.

FIG. 5 diagrammatically illustrates, in a side elevational view, a cylinder configuration in an otherwise non-illustrated printing unit 2 represented only by cylinders 11 and 16. The detector 13 scans the surface of a plate cylinder 16 thereof. If the detector 13 detects the gap 17 formed in the plate cylinder 16, then, via a connecting line 15, as in the aforedescribed case, the marking device 10 is activated. To insure that, when the gap 17 of the plate cylinder 16 is recognized, the marking device 10 applies the marks 9 in the image-free region on the web 6, the distance $d_1$ of the marking device 10 from the printing nip 14 is set to correspond to the sum of the circumferential distances $d_2$ and $d_3$ on the cylinders 11 and 16 from the measuring point of the detector 13 to the printing nip 14. In this specific embodiment of the invention, of course, it is also possible to increase the distance $d_1$ of the marking device 10 from the printing nip 14 by an integral multiple of the cylinder circumference d. Assurance is then always provided that the marking device 10 will be activated in an image-free region of the web 6.

Figure 6:
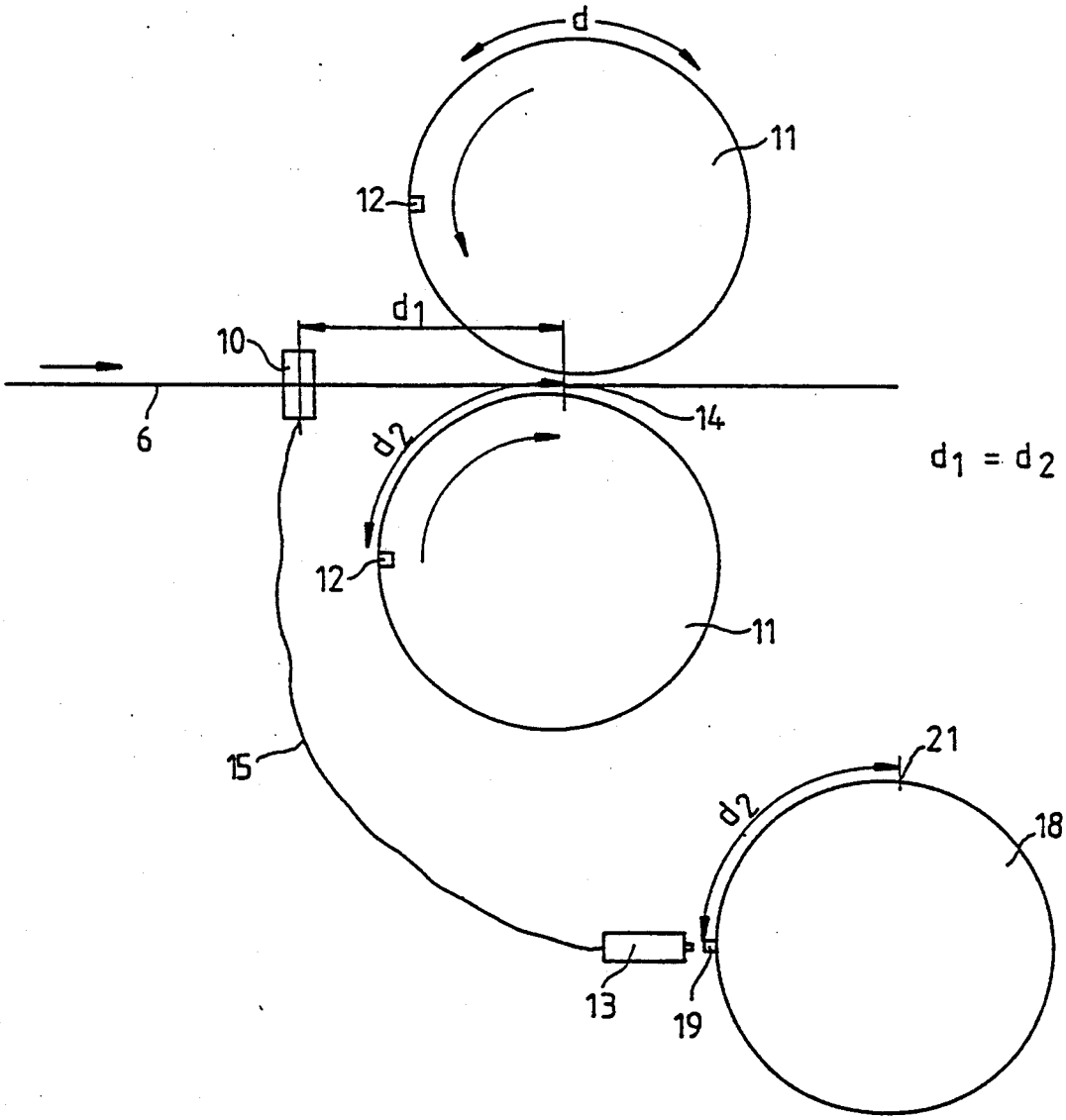
FIG. 6 is a view like that of FIGS. 4 and 5 of a third embodiment of the device according to the invention.

In FIG. 6, an additional embodiment of the device according to the invention is illustrated wherein the detector 13 is assigned at random to a cylinder 18 of the printing press 1. This cylinder 18 rotates at machine speed and carries the characterizing or reference mark 19, the angular position of which is synchronized with the gap 12 of the blanket cylinder 11. The instant the detector 13 detects this reference mark 19, the marking device 10 is activated via a connecting line 15. In this embodiment of the invention, also, the distance $d_1$ of the marking device 10 from the printing nip 14 is measured so that a delay-free actuation of the marking device 10 places the mark 9 reliably in the image-free region of the web 6. In this regard, either the distance $d_1$ is equal to the circumferential distance $d_2$ extending from the measuring location of the detector 13 to a corresponding nip location 21 on the cylinder 18 extending parallel to the nip 14 between the blanket cylinders 11, or the distance $d_1$ is combined, as in the hereinafore described embodiments, from the sum of the circumferential distance $d_2$ and an integral multiple of the cylinder circumference d.

In all of the embodiments described hereinbefore, the detector 13 is formed as a reflection detector. The instant a contrast change appears as a result of the scanning of the gap 12, 17 of a cylinder 11, 16 or as a result of the scanning of a synchronously rotating reference mark 19, the marking device 10 is activated without delay. Due to the defined distance of this marking device 10 from the printing nip 14, preferably of a first printing unit, assurance is provided that the marking device 10 will place the marks 9 in the image-free regions of the web 6.

Figure 7:
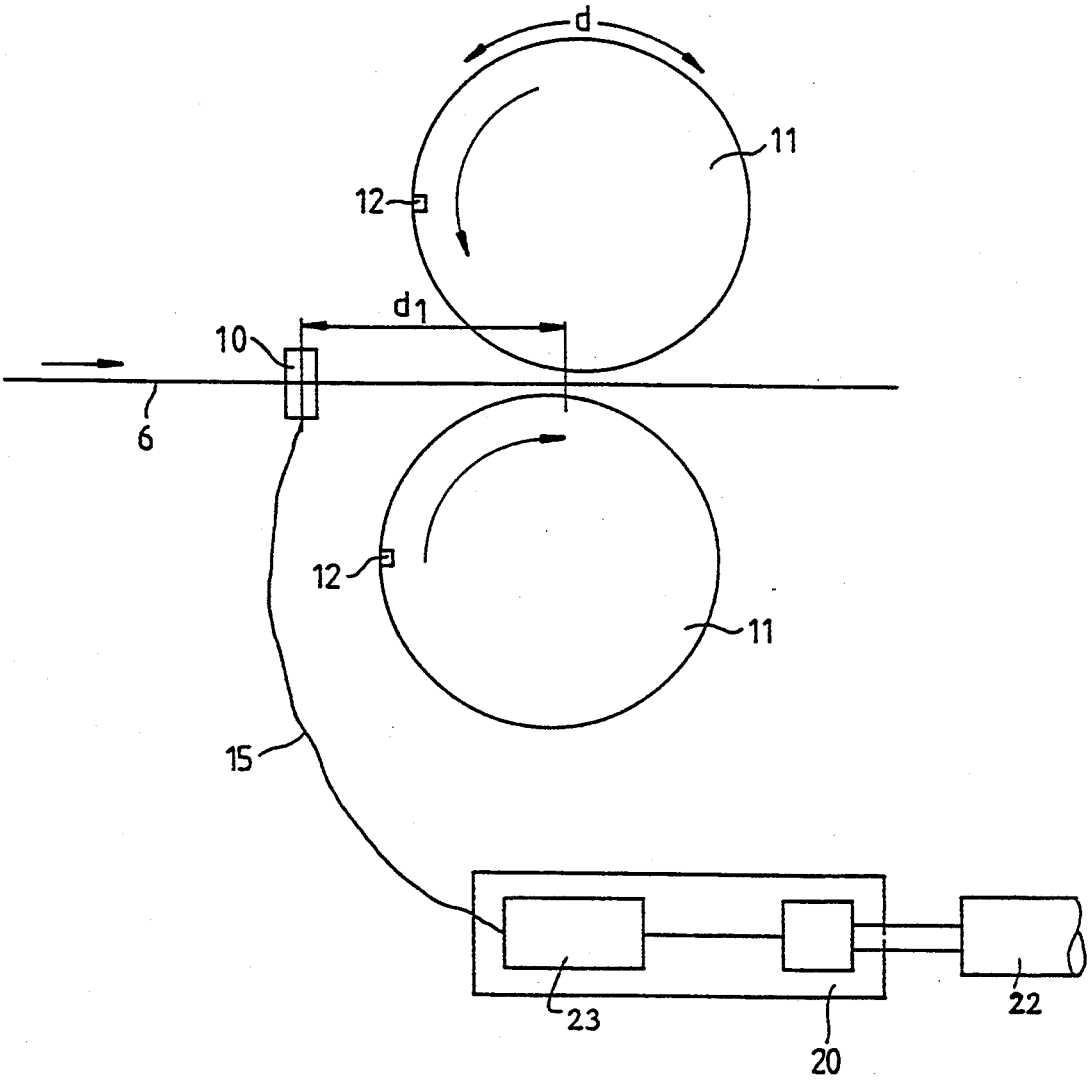
FIG. 7 is a view like that of FIGS. 4, 5 and 6 of a fourth embodiment of the device according to the invention.

According to yet another embodiment of the invention illustrated in FIG. 7, the detector is formed as an angle encoder or detector 20 mounted on a shaft of a cylinder 22 of the printing press. The gap 12 of the respective cylinder is not directly, but rather indirectly detected by means of the angular position of the cylinder 22 of the printing press 1. The distance $d_1$ of the marking device 10 from the printing nip 14 is also measured in this embodiment so that, for example, in an angular position 0° transmitted by the angle encoder of the web-fed printing press 1, the marking device 10 is activated in the image-free region of the web 6. A memory 23 is additionally provided for storing angular positions therein which correspond to the image-free regions of the web.

I claim:

1. Device for presetting a cut-off register in a folder of a web-fed printing press, comprising a marking device for applying at least one mark in an image-free region between two printed images of a web, detector means for detecting the image-free region on the web, said detector means being connected to said marking device for signalling said marking device when the image-free region is detected thereby, said marking device being disposed a defined distance in front of a nip located between cylinders of at least one printing unit, and means for activating the marking device to apply a mark to the image-free region of the web when a respective output signal of said detector indicates the presence of the image-free region on the web; said detector means having a reflection detector for scanning the surface of a plate cylinder having a gap formed therein and located adjacent one of the first-mentioned cylinders, said defined distance at which said marking device is disposed in front of said nip corresponding to a sum of circumferential distances extending from a measuring location of said detector means on the plate cylinder to said nip, said marking device being activated when the gap of the plate cylinder is detected by said reflection detector.

2. Device according to claim 1, wherein said distance of said marking device from said nip is increased by an integral multiple of the circumference of one of said cylinders.

3. Device according to claim 1, wherein the one of the first-mentioned cylinders is a blanket cylinder defining another nip with said plate cylinder, one of said circumferential distances extending from said measuring location of said detector means on said plate cylinder to said other nip, and the other of said circumferential distances extending from said other nip on said blanket cylinder to said first-mentioned nip.

4. Device according to claim 3, wherein said distance of said marking device from said nip is increased by an integral multiple of the circumference of one of said cylinders.

* * * * *

UNITED STATES PATENT AND TRADEMARK OFFICE

CERTIFICATE OF CORRECTION

PATENT NO. : 5,415,092

DATED : May 16, 1995

INVENTOR(S) : Joel Cleo Hern

It is certified that error appears in the above-indentified patent and that said Letters Patent is hereby corrected as shown below:

On the title page, item [62], change

"Division of Ser. No. 947,785, Sep. 18, 1992, Pat. No. 5,299,770."

to

-- Division of Ser. No. 947,765, Sep. 18, 1992, Pat. No. 5,289,770. --

Signed and Sealed this

Twenty-eighth Day of November 1995

*Attest:*

Bruce Lehman

BRUCE LEHMAN

*Attesting Officer*

*Commissioner of Patents and Trademarks*